US009190753B2

(12) United States Patent
Takaki

(10) Patent No.: US 9,190,753 B2
(45) Date of Patent: Nov. 17, 2015

(54) ELECTRICAL CONNECTOR

(71) Applicant: IRISO ELECTRONICS CO., LTD., Kanagawa (JP)

(72) Inventor: Masato Takaki, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/456,028

(22) Filed: Aug. 11, 2014

(65) Prior Publication Data

US 2015/0056830 A1 Feb. 26, 2015

(30) Foreign Application Priority Data

Aug. 20, 2013 (JP) ..... 2013-170190

(51) Int. Cl.

| | |
|---|---|
| ***H01R 13/11*** | (2006.01) |
| ***H01R 12/71*** | (2011.01) |
| ***H01R 12/73*** | (2011.01) |
| ***H01R 13/52*** | (2006.01) |

(52) U.S. Cl.
CPC ..... *H01R 12/716* (2013.01); *H01R 12/73* (2013.01); *H01R 13/52* (2013.01)

(58) Field of Classification Search
CPC ..... H01R 12/716; H01R 13/2492; H01R 13/2464
See application file for complete search history.

(56) References Cited

U.S. PATENT DOCUMENTS

| | | | | | |
|---|---|---|---|---|---|
| 3,199,066 | A | * | 8/1965 | William et al. | 439/857 |
| 3,631,381 | A | * | 12/1971 | Pittman | 439/637 |
| 4,106,841 | A | * | 8/1978 | Vladic | 439/188 |
| 4,725,250 | A | * | 2/1988 | Kuhn et al. | 439/629 |
| 4,891,023 | A | * | 1/1990 | Lopata | 439/637 |

(Continued)

FOREIGN PATENT DOCUMENTS

| | | |
|---|---|---|
| EP | 2093841 A2 | 8/2009 |
| EP | 2442405 A1 | 4/2012 |

(Continued)

OTHER PUBLICATIONS

Notice of Reasons for Rejection from Japanese Patent App. No. 2013-170190 (Drafting date Sep. 26, 2013) with certified English language translation.

(Continued)

*Primary Examiner* — James Harvey
(74) *Attorney, Agent, or Firm* — Cermak Nakajima & McGowan LLP; Tomoko Nakajima

(57) ABSTRACT

An electrical connector includes a terminal that includes a front terminal portion, and a rear terminal portion the contact position of which is located further from the insertion opening of the connector than the contact position of the front terminal portion, and that is electrically connected with a mating terminal as an object to be connected. The front terminal portion has a front elastic arm, and a front contact portion formed at the distal end of the front elastic arm, and the front contact portion has a front contact that comes into contact with the mating terminal, and a dummy contact that is located closer to the insertion opening of the connector than the front contact, and that wipes a foreign substance adhering to the mating terminal.

10 Claims, 3 Drawing Sheets

(56) References Cited

U.S. PATENT DOCUMENTS

| | | | | |
|---|---|---|---|---|
| 6,015,299 | A * | 1/2000 | Walse et al. | 439/60 |
| 6,095,821 | A * | 8/2000 | Panella et al. | 439/60 |
| 6,309,254 | B1 * | 10/2001 | Korsunsky | 439/637 |
| 6,439,930 | B1 * | 8/2002 | Korsunsky et al. | 439/637 |
| 6,764,345 | B1 | 7/2004 | Duesterhoeft et al. | |
| RE38,736 | E * | 5/2005 | Walse et al. | 439/60 |
| 8,491,340 | B2 * | 7/2013 | Sass et al. | 439/636 |
| D717,738 | S * | 11/2014 | Takaki | D13/154 |
| 2005/0245144 | A1 | 11/2005 | Hegel | |
| 2007/0087636 | A1 | 4/2007 | Masuda | |
| 2012/0142226 | A1 | 6/2012 | Funayama et al. | |
| 2015/0024620 | A1 * | 1/2015 | Kobayashi et al. | 439/345 |
| 2015/0056830 | A1 * | 2/2015 | Takaki | 439/148 |

FOREIGN PATENT DOCUMENTS

| | | | |
|---|---|---|---|
| JP | 53-133790 | A | 11/1978 |
| JP | 63-87787 | U | 6/1988 |
| JP | 11-233183 | A | 8/1999 |
| JP | 2001-345134 | A | 12/2001 |
| JP | 2004-256096 | A | 12/2004 |
| JP | 2012-069243 | A | 4/2012 |
| WO | WO2010/143520 | A1 | 12/2010 |

OTHER PUBLICATIONS

European Search Report for European Patent App. No. 14180466.6 (Nov. 17, 2014).

* cited by examiner

ELECTRICAL CONNECTOR

BACKGROUND OF THE INVENTION

1. Field of the Invention

The present invention relates to an electrical connector having a terminal having a contact that wipes a foreign substance and a contact that is electrically connected to a mating terminal.

2. Description of the Related Art

A foreign substance such as board debris or dust may adhere to the surface of a mating terminal to which a terminal is electrically connected. If the foreign substance is caught between the contact of the terminal and the mating terminal, electrical connection between the terminals may become unstable. As a countermeasure, there has been known a terminal including two terminal portions having contacts at the distal ends thereof, one of the contacts being formed for wiping a foreign substance, and the other being formed for electrical connection with a mating terminal. Such a terminal is described, for example, in Japanese Unexamined Patent Application Publication No. 2012-69243.

However, if two terminal portions are provided, contact pressure of each terminal portion is applied to the mating terminal, and therefore insertion force when fitting to the mating connector increases. Therefore, compared to the case where the number of terminal portions is one, the connector feels heavy for an operator fitting the connector, and operability deteriorates.

SUMMARY OF THE INVENTION

The present invention has been made to solve the above problem, and it is an object of the present invention to provide an electrical connector having a terminal that can remove a foreign substance effectively, and that provides a good insertion feeling.

To attain the above object, the present invention is configured as follows.

An electrical connector includes a terminal that includes a front terminal portion, and a rear terminal portion the contact position of which is located further from the insertion opening than the contact position of the front terminal portion, and that is electrically connected with a mating terminal as an object to be connected. The front terminal portion has a front elastic arm, and a front contact portion formed at the distal end of the front elastic arm. The front contact portion has a front contact that comes into contact with the mating terminal, and a dummy contact that is located closer to the insertion opening than the front contact, and that wipes a foreign substance adhering to the mating terminal.

Since this electrical connector has a front terminal portion, and a rear terminal portion the contact position of which is located further from the insertion opening than the contact position of the front terminal portion, both the front terminal portion and the rear terminal portion can be connected to one mating terminal.

Since the front terminal portion has a front elastic arm, and a front contact portion formed at the distal end of the front elastic arm, the front contact portion can be elastically deformed using the front elastic arm as a spring. Since the front contact portion has a front contact that comes into contact with the mating terminal, and a dummy contact that is located closer to the insertion opening than the front contact, and that wipes a foreign substance adhering to the mating terminal, the foreign substance can be caught between the mating terminal and the dummy contact and taken in. If the foreign substance cannot be taken in by the dummy contact, the foreign substance can be taken in by the front contact. Therefore, the foreign substance can be removed by taking in the foreign substance with both the dummy contact and the front contact.

As with the front terminal portion, the rear terminal portion can be provided with an elastic arm portion, and a contact portion having a contact. As with the front terminal portion, the rear contact can be brought into contact with the mating terminal by elastically deforming the rear elastic arm. That is, if the front contact portion catches the foreign substance and thereby does not function as a terminal, electrical connection can be secured by the rear terminal portion. The front terminal portion and the rear terminal portion can be curved independently of each other, the shapes of the contact portions can also be formed independently of each other. Therefore, the front terminal portion and the rear terminal portion can be designed so as to have insertion forces independent of each other.

If the terminal is formed by blanking a flat plate, the plate thickness surface of metal can be used as contacts. If there are two contacts, both the two contacts can be provided within the plate thickness, and therefore misalignment of contacts can be made less likely to occur. The dummy contact, the front contact, and the rear contact can all be brought into contact with the mating connector in the same plane along the insertion and removal direction.

A dummy contact insertion angle C1 formed between a virtual line along the insertion and removal direction and the insertion opening side edge of the dummy contact may be formed smaller than a front contact insertion angle F1 formed between the virtual line and the insertion opening side edge of the front contact.

Since a dummy contact insertion angle C1 formed between a virtual line along the insertion and removal direction and the insertion opening side edge of the dummy contact is formed smaller than a front contact insertion angle F1 formed between the virtual line and the insertion opening side edge of the front contact, the insertion force of the front terminal portion having the dummy contact can be reduced.

A dummy contact angle C2 formed between the insertion opening side edge of the dummy contact and the inner edge of the dummy contact on the side opposite to the insertion opening side may be formed to be more than 90 degrees. Since a dummy contact angle C2 formed between the insertion opening side edge of the dummy contact and the inner edge on the side opposite to the insertion opening side is formed to be more than 90 degrees, removal of the foreign substance can be performed effectively.

An inclined surface that makes the thickness of the dummy contact less than the thickness of a part around the dummy contact may be provided in the front contact portion. Since an inclined surface that makes the thickness of the dummy contact less than the thickness of a part around the dummy contact is provided in the front contact portion, a foreign substance formed by melt-adhesion of abrasion debris of resin material to the mating terminal can be cut with the dummy contact the distal end of which is thinned. Therefore, the capability of removing such a foreign substance can be improved.

The distal end of the front contact may be more protruded toward the mating terminal than the distal end of the dummy contact. Since the distal end of the front contact is more protruded toward the mating terminal than the distal end of the dummy contact, in other words, the front contact portion is formed such that the front contact is more protruded toward the mating terminal in the front-rear direction than the dummy contact, if a foreign substance cannot be held between the dummy contact and the mating terminal and cannot be removed, the foreign substance can be held and removed by the front contact portion, and the foreign substance removing capability can be improved.

The electrical connector of the present invention can remove a foreign substance to make poor conduction less likely to occur. The insertion pressure during fitting of the connector can be reduced, and the insertion feeling can be improved.

DESCRIPTION OF THE PREFERRED EMBODIMENTS

The present invention will be described by way of embodiments in more detail.

Figure 1:
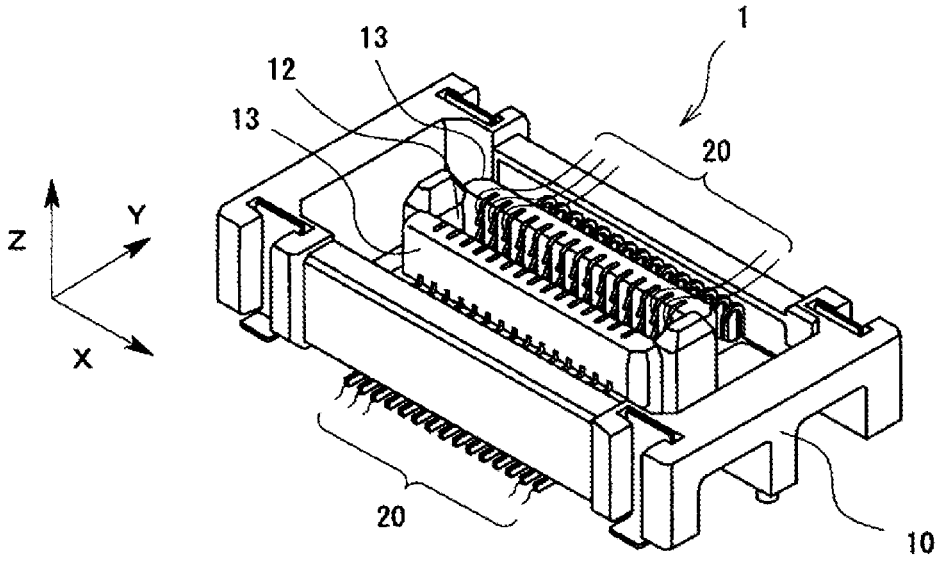
FIG. 1 is a perspective view of an electrical connector.

FIG. 1 is a perspective view of an electrical connector 1 in which terminals 20 are assembled to a housing 10. The electrical connector 1 is installed on a member to be connected (not shown) such as a printed board, and is fitted to a mating connector (not shown) installed on another printed board or the like. The terminals 20 of the electrical connector 1 come into contact with mating terminals of the mating connector, and the printed boards are thereby electrically connected to each other.

In the description of this specification and claims, for convenience sake, the X direction of FIG. 1 will be referred to as a width direction, the Y direction will be referred to as a front-rear direction, and the Z direction will be referred to as a vertical direction (insertion and removal direction). However, the installation direction or the use direction of the electrical connector 1 is not determined by these directions.

The housing 10, in which the terminals 20 are spaced from each other in the width direction, and which is fitted to the mating connector, is molded of synthetic resin, and has a groove 12 formed by vertical walls 13, and an insertion opening receiving the mating connector. The housing 10 further has terminal fixing grooves (not shown), which fix the terminals 20.

Figure 2:
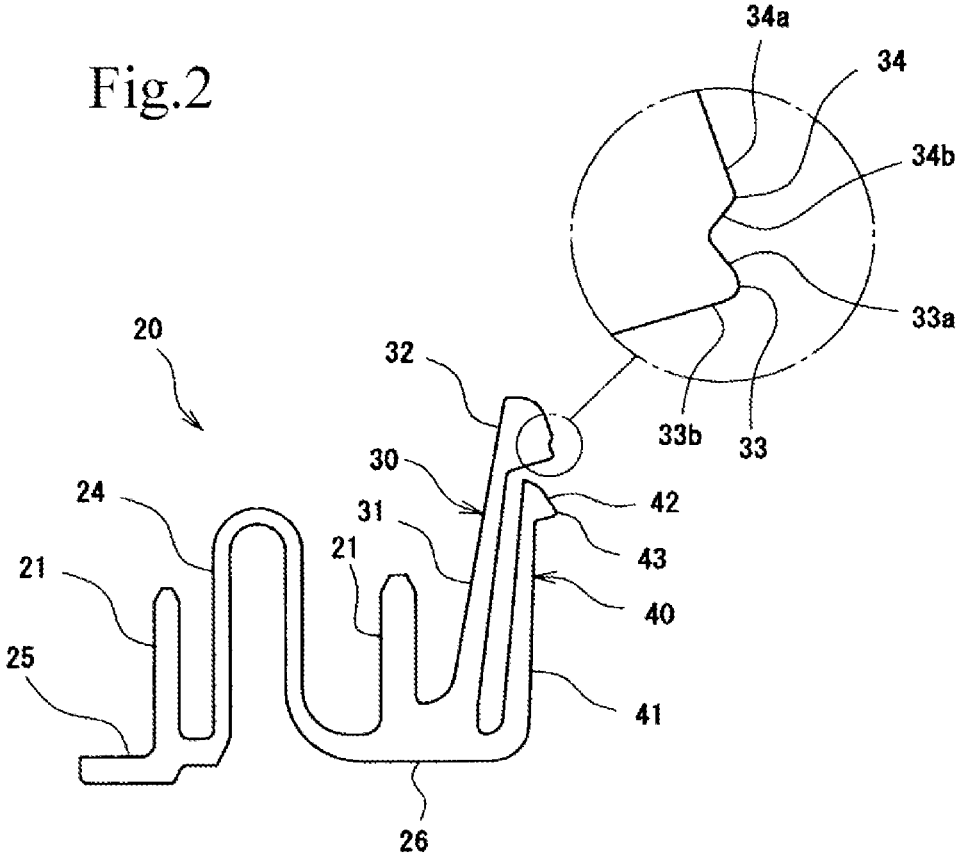
FIG. 2 is a plan view of a terminal of the electrical connector of FIG. 1.

The terminals 20 can be formed by blanking an electrically conductive metal plate in the thickness direction, and include, as shown in FIG. 2, fixing portions 21 used for fixation to the housing 10, a front terminal portion 30 and a rear terminal portion 40 capable of elastic deformation in the front-rear direction, a third elastic arm 24 formed between the two fixing portions 21, a connecting portion 25 connected to a board, and a base end portion 26 continuous with the base ends of the front and rear terminal portions 30 and 40. The terminals 20 are arranged such that they form two rows in the width direction in the housing 10 and such that the thickness direction of the fixing portion 21 and the terminal portions 30 and 40 is the width direction.

The front terminal portion 30 has a front elastic arm 31 extending vertically, and a front contact portion 32 formed at the distal end of the front elastic arm 31. The front contact portion 32 has a front contact 33 that comes into contact with the mating terminal, and a dummy contact 34 that is located closer to the insertion opening of the electrical connector 1 than the front contact 33 (above the front contact 33) and that wipes a foreign substance adhering to the mating terminal. Foreign substances adhering to the mating terminal include fiber, dust, board abrasion debris, molding abrasion debris, flux, and cellulose.

Figure 3:
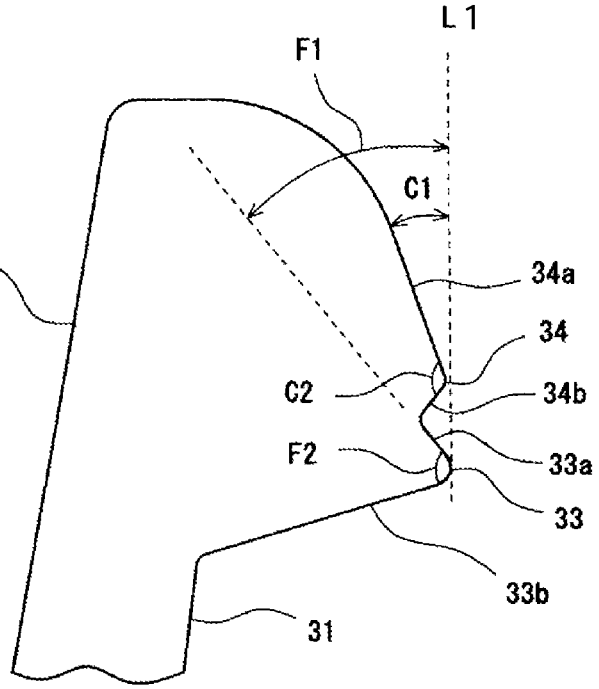
FIG. 3 is a partial enlarged view of a front terminal portion of the terminal of FIG. 2.

FIG. 3 is an enlarged view of a part of the front terminal portion 30.

A dummy contact insertion angle C1 formed between a virtual line L1 along the insertion and removal direction of the electrical connector 1 and the insertion opening side edge 34*a* of the dummy contact 34 is formed smaller than a front contact insertion angle F1 formed between the virtual line L1 and the insertion opening side edge 33*a* of the front contact 33.

More specifically, the dummy contact insertion angle C1 is preferably 15 degrees to 45 degrees, and the front contact insertion angle F1 is preferably larger than the dummy contact insertion angle C1. If the dummy contact insertion angle C1 is more than 45 degrees, the insertion force of the front terminal portion 30 is too large, and the insertion feeling is bad. If the dummy contact insertion angle C1 is less than 15 degrees, the foreign substance removing effect of the dummy contact 34 is small. The front contact insertion angle F1 of the front contact 33 is preferably not more than 90 degrees. If the front contact insertion angle F1 is more than 90 degrees, the front contact portion 32 is too large in the vertical direction, the space between the front contact portion 32 and the rear contact portions 42 is large, and compact fitting of connectors cannot be performed.

While the insertion angle C1 of the dummy contact 34 is small, a dummy contact angle C2 formed between the insertion opening side edge 34*a* of the dummy contact 34 and the inner edge 34*b* on the side opposite to the insertion opening side is formed to be more than 90 degrees. When the dummy contact angle C2 is small, it is likely that after a foreign substance comes into contact with the dummy contact 34, the foreign substance is pushed to either side of the dummy contact 34 or climbs over the dummy contact 34 and moves to directly behind the dummy contact 34. By contrast, when the dummy contact angle C2 is more than 90 degrees, the area in the plate surface direction around the dummy contact is large, and therefore a foreign substance is less likely to move to directly behind the dummy contact 34, and is less likely to climb over the dummy contact 34. Therefore, the probability that after a foreign substance comes into contact with the dummy contact 34, the foreign substance comes into contact with the front contact 33 and the rear contact 43 can be reduced, and therefore removal of the foreign substance can be performed effectively.

A depression is formed between the dummy contact 34 and the front contact 33, which are protruded, so as to be a saddle portion. However, the depth of the depression is preferably not more than 0.05 mm. The reason is that if the depression is too deep, the dummy contact angle C2 is small, and the foreign substance removing capability of the dummy contact 34 is low.

Although the dummy contact 34 is equal in thickness to the front contact 33, the dummy contact 34 may be made thinner than the front contact 33, for example, by reducing the plate thickness of the dummy contact 34 part. The reason is that thinning the dummy contact 34 reduces the friction coefficient of the dummy contact 34 and reduces the insertion force. If the dummy contact 34 is thin, a foreign substance can be removed by a part of the dummy contact 34 in contact with the mating terminal. If the dummy contact 34 fails to remove a foreign substance owing to its reduced thickness, the foreign substance can be removed by the front contact 33.

Figure 4:
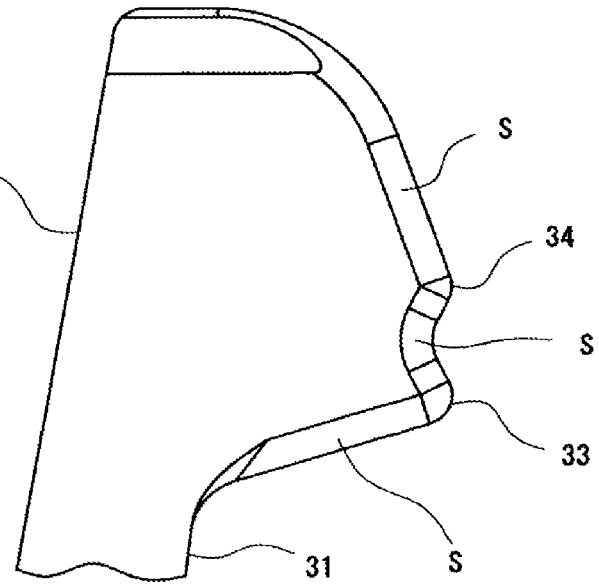
FIG. 4 is an enlarged schematic view showing the thickness difference in the plate thickness direction of the front terminal portion of the terminal of FIG. 2.

The distal ends of the dummy contact 34 and the front contact 33 can be formed thinner than the thickness of the other part of the front contact portion 32, that is, the plate thickness of the terminal 20. As shown in FIG. 4, in order to make the thicknesses of the dummy contact 34 and the front contact 33 less than the plate thickness of the front contact portion 32, inclined surfaces S extending from the plate surface of the front contact portion 32 to the dummy contact 34 and the front contact 33 may be formed around the dummy contact 34 and the front contact 33.

By forming such inclined surfaces S, sliding surfaces of the dummy contact 34 and the front contact 33 that slide relative to the mating terminal can be thinned, and the thicknesses of the sliding surfaces of the dummy contact 34 and the front contact 33 can be changed. If the dummy contact 34 is formed like a cutting edge, a foreign substance or the like melt-adhering to the mating terminal can be divided to weaken the adhesion force to the mating terminal, and can then be wiped and removed with the front contact 33.

The front contact 33 is formed so as to be more protruded toward the mating terminal in the front-rear direction than the dummy contact 34, preferably by 0.01 mm to 0.05 mm. If the front contact 33 is formed so as to be more protruded toward the mating terminal in the front-rear direction than the dummy contact 34 by 0.01 mm to 0.05 mm, a large foreign substance more than or equal to 0.05 mm in size is easily removed by the dummy contact 34, and a foreign substance less than 0.05 mm in size is easily removed by the front contact 33.

Figure 5:
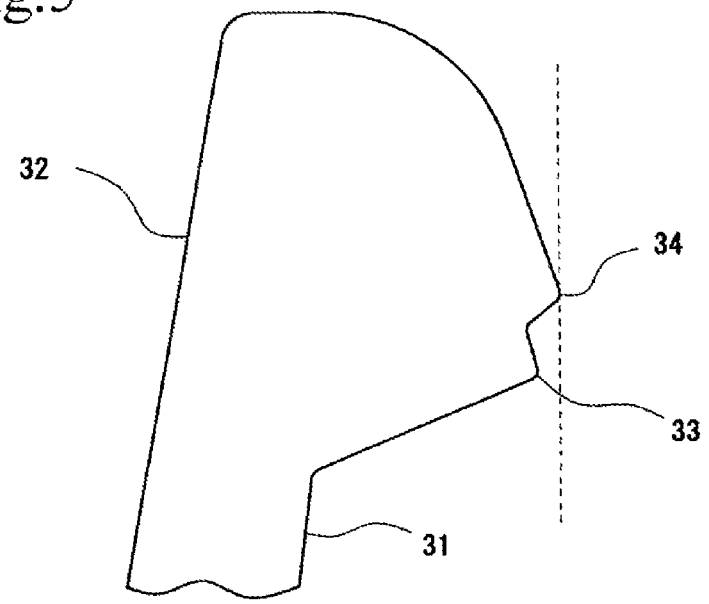
FIG. 5 is a partial enlarged view of another embodiment of a front terminal portion corresponding to FIG. 3.

Conversely to the above example, as shown in FIG. 5, the dummy contact 34 may be more protruded toward the mating terminal than the front contact 33. In this case, after the dummy contact 34 comes into contact with the mating terminal, the front elastic arm 31 bends and the front contact 33 comes into contact with the mating terminal. By protruding the dummy contact 34, the contact pressure of the front terminal portion 30 can be reduced.

As with the front terminal portion 30, the rear terminal portion 40 has a rear elastic arm 41, and a rear contact portion 42 having a rear contact 43. However, the rear terminal portion 40 is not provided with a dummy contact.

Figure 6:
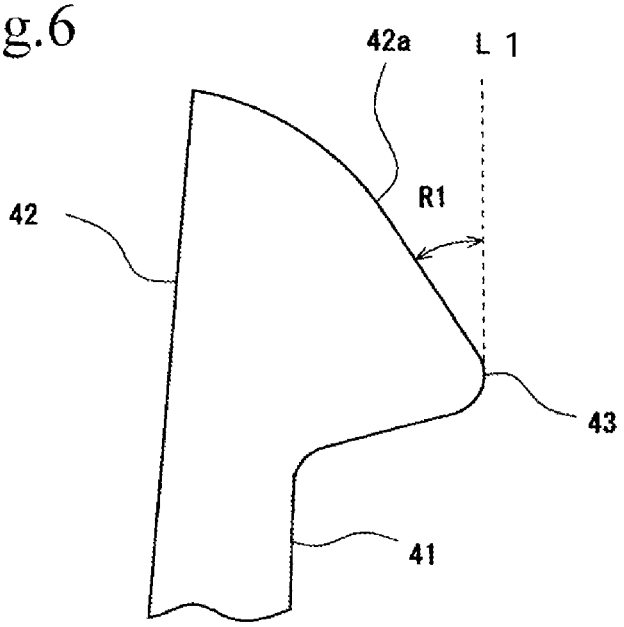
FIG. 6 is a partial enlarged view of a rear terminal portion of the terminal of FIG. 2.

As shown in FIG. 6, a rear contact insertion angle R1 between the insertion opening side edge 42*a* of the rear contact portion 42 and the virtual line L1 is preferably small. The reason is that the smaller the rear contact insertion angle R1, the smaller the insertion force of the rear terminal portion 40, and the better the insertion property.

The rear terminal portion 40 is formed such that the rear contact 43 is more protruded toward the mating terminal in the front-rear direction than the front contact 33. By protruding the rear contact 43 more than the front contact 33, the contact pressure of the rear contact 43 can be easily increased, and reliable electrical connection with the mating terminal can be established.

The third elastic arm 24 is formed in an inverted U-shape between one end thereof leading to the connecting portion 25 and the other end thereof leading to the base end portion 26. By elastically deforming this inverted U in the front-rear direction, the vertical wall 13 can be moved in the front-rear direction.

The connecting portion 25 is protruded to the outside from the housing 10, and is electrically connected to a board, for example, by being soldered to a contact on the board.

The base end portion 26 is a portion serving as the base ends of the terminal portions 30 and 40 and fixed to the housing 10 through the fixing portion 21.

The mating connector (not shown) has a mating housing that is fitted to the housing 10 of the electrical connector 1, and a plurality of mating terminals that are spaced from each other in the width direction in the mating housing. The electrical connector 1 and the mating connector configured as above are fitted together by inserting the mating connector into the insertion opening forming the groove 12 of the electrical connector 1, and the terminals 20 of the electrical connector 1 come into contact with their respective mating terminals. At this time, the dummy contact 34, the front contact 33, and the rear contact 43 of the terminal 20 come into contact with the same position in the width direction of the mating terminal in order at intervals in the vertical direction. Therefore, a total of three terminals of the terminal 20 come into contact with one mating terminal.

During such fitting of the connector, the insertion pressure of the front terminal portion 30 can be reduced since the insertion angle C1 of the dummy contact 34 of the terminal 20 is small. Therefore, the operation feeling during fitting of the connector can be improved. The insertion force (insertion pressure) when inserting the electrical connector 1 into the mating connector is a function of the contact pressure of the contact, frictional resistance, and the angle of the contact with respect to the insertion and removal direction, that is, the dummy contact insertion angle C1. Therefore, by reducing the dummy contact insertion angle C1, the insertion force of the front terminal portion 30 can be reduced.

The dummy contact angle C2 of the dummy contact 34 is formed to be more than 90 degrees, so that the probability that after a foreign substance comes into contact with the dummy contact 34, the foreign substance adheres on the orbits of the contacts 33 and 43 again is reduced.

Since the front terminal portion 30 is provided with the front contact 33 having the front contact insertion angle F1 larger than the dummy contact insertion angle C1, if a foreign substance cannot be removed by the dummy contact 34, the foreign substance can be removed by the front contact 33.

Since the terminal 20 has two terminals: the front terminal portion 30 and the rear terminal portion 40, if a foreign substance adheres to the dummy contact 34 or the front contact 33 provided in the front contact portion 32, the rear contact 43 can be brought into contact with the mating terminal after the dummy contact 34 and the front contact 33 have passed the mating terminal. Thus, the front contact portion 32 can remove a foreign substance, and the rear contact 43 can reliably come into contact with the mating terminal and establish electrical connection therewith. Therefore, reliable electrical connection can be established between boards connected to the connectors.

If an electrically conductive metal plate is blanked in the thickness direction and the plate thickness surface is used as contacts, a plurality of terminals can be arranged in the thickness direction of the metal plate in a small space, and the terminals 20 can be arranged at high density in the width direction of the electric connector 1.

The above-described embodiments are illustrative only, the present invention is not limited to the above-described embodiments, and various changes may be made therein without departing from the scope of the present invention.

For example, the terminals 20 may be provided not in the housing 10 which is a socket-type housing but in the mating housing which is a plug-type housing. In such a case, the distal ends of both terminal portions 30 and 40 correspond to the insertion opening side of the mating terminal (socket-type housing), and therefore the above description illustrating the contact position can be applied as it is.

The shape, size, position, and number of the fixing portion 21, the connecting portion 25, the third elastic arm 24, and the base end portion 26 may be changed. Various changes may be made, for example, the third elastic arm 24 may not be provided. The shape, position, and so forth of the elastic arms of the front terminal portion 30 and the rear terminal portion 40 may be changed. Another configuration may be added, for example, a third contact other than the front contact and the rear contact may be provided.

What is claimed is:

1. An electrical connector comprising:

a terminal which is electrically connected with a mating terminal as an object to be connected, and is formed of a metal plate in a predetermined thickness, the terminal includes a front terminal portion having a first contact position, and a rear terminal portion having a second contact position which is located further from an insertion opening than the first contact position of the front terminal portion, wherein the front terminal portion has a front elastic arm, and a front contact portion formed at a distal end of the front elastic arm, and wherein the front contact portion has a front contact that is formed on a plate thickness surface of the metal plate and that comes into contact with the mating terminal, and a dummy contact that is located closer to the insertion opening than the front contact, that is formed on the plate thickness surface of the metal plate, and that wipes a foreign substance adhering to the mating terminal.

2. The electrical connector according to claim 1, wherein a dummy contact insertion angle formed between a virtual line along the insertion and removal direction and the insertion opening side edge of the dummy contact is formed smaller than a front contact insertion angle formed between the virtual line and the insertion opening side edge of the front contact.

3. The electrical connector according to claim 1, wherein a dummy contact angle formed between an insertion opening side edge of the dummy contact and an inner edge on the side opposite to the insertion opening side is formed to be more than 90 degrees.

4. The electrical connector according to claim 1, wherein an inclined surface that makes the thickness of the dummy contact less than the thickness of a part around the dummy contact is provided in the front contact portion.

5. The electrical connector according to claim 1, wherein the distal end of the front contact is more protruded toward the mating terminal than the distal end of the dummy contact.

6. The electrical connector according to claim 1, wherein a depression is formed between the front contact and the dummy contact.

7. The electrical connector according to claim 1, wherein the plate thickness part of the dummy contact is formed thinner than the plate thickness part of the front contact.

8. The electrical connector according to claim 1, wherein the rear terminal portion is provided with a rear contact that comes into contact with the mating terminal, and the distal end of the rear contact is more protruded toward the mating terminal than the distal end of the front contact.

9. The electrical connector according to claim 1, further comprising:

a housing to which the terminal is assembled, the housing having the insertion opening to receive the mating connector.

10. The electrical connector according to claim 9, wherein the insertion opening is defined by vertical walls.

* * * * *